US005637205A

United States Patent [19]

Krupicka et al.

[11] Patent Number: 5,637,205

[45] Date of Patent: Jun. 10, 1997

[54] PROCESS FOR THE ELECTROLYTICAL COATING OF AN OBJECT OF STEEL ON ONE OR BOTH SIDES

[75] Inventors: Ulrich Krupicka, Vienna; Gerald Maresch, Mödling, both of Austria

[73] Assignee: Andritz-Patentverwaltungs-Gesellschaft M.B.H., Graz, Austria

[21] Appl. No.: 146,128

[22] PCT Filed: May 13, 1992

[86] PCT No.: PCT/AT92/00068

§ 371 Date: Dec. 20, 1993

§ 102(e) Date: Dec. 20, 1993

[87] PCT Pub. No.: WO92/20839

PCT Pub. Date: Nov. 26, 1992

[30] Foreign Application Priority Data

May 13, 1991 [AT] Austria ..... 980/91

[51] Int. Cl.[6] ..... C25D 21/06; C25D 21/16; C25D 7/06; C25D 3/56

[52] U.S. Cl. ..... 205/98; 205/99; 205/100; 205/101; 205/130; 205/138; 205/141; 205/210; 205/215; 205/216; 205/245; 205/305

[58] Field of Search ..... 205/98, 100, 101, 205/130, 141, 215, 217, 245, 305, 99, 138, 140, 142, 210

[56] References Cited

U.S. PATENT DOCUMENTS

| | | | |
|---|---|---|---|
| 4,444,629 | 4/1984 | Martin | 204/437 |
| 4,541,903 | 9/1985 | Kyono | 204/28 |
| 5,246,563 | 9/1993 | Maresch | 204/141 |

FOREIGN PATENT DOCUMENTS

| | | |
|---|---|---|
| 569442 | 1/1959 | Canada . |
| 151 235 | 8/1985 | European Pat. Off. . |
| 9104359 | 4/1991 | WIPO . |

*Primary Examiner*—John Niebling
*Assistant Examiner*—Edna Wong
*Attorney, Agent, or Firm*—Ladas & Parry

[57] ABSTRACT

The invention describes a process for the electrolytical coating of an object of steel on one or both sides. Preferably, the object is a steel strip with zinc or a zinc iron alloy. Zinc or a zinc iron alloy is deposited on the object when the object is connected to form the cathode of a galvanic cell in an aqueous solution of zinc chloride and iron chloride with a pH of 0.1 to 3.0. The zinc chloride solution has a concentration of 50 to 1000 g/l for the deposition of metallic zinc. A partial flow of electrolyte solution is past continuously into a column filled with metallic zinc, where the trivalent iron formed there during the electrolysis is reduced to a bivalent iron, and metallic zinc is dissolved simultaneously therewith. The invention also describes an apparatus for the electrolytical coating of an object of steel.

11 Claims, 2 Drawing Sheets

Figure 1:
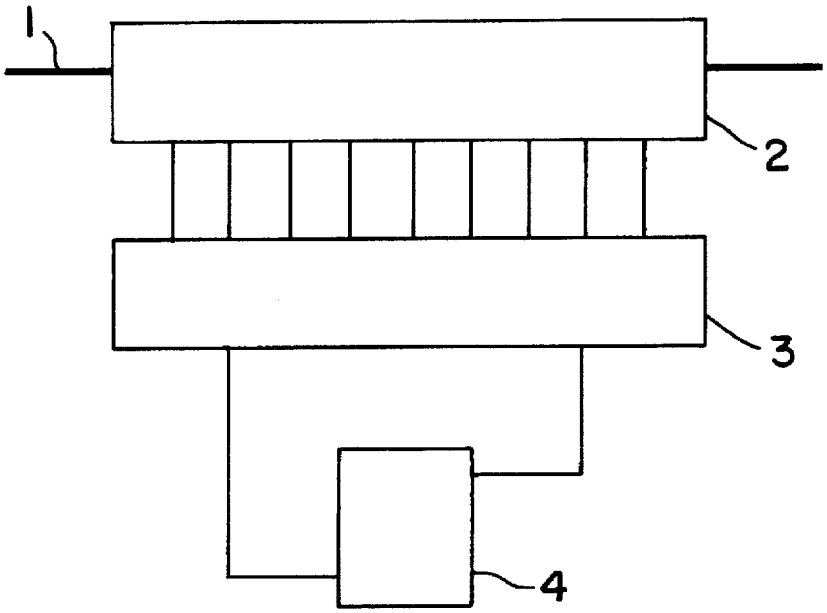

PROCESS FOR THE ELECTROLYTICAL COATING OF AN OBJECT OF STEEL ON ONE OR BOTH SIDES

The invention relates to a process for the electrolytical coating on one or both sides of an object of steel, connected as a cathode, on one or both sides, preferably a steel strip, or made of hot dip galvanised steel, preferably a hot dip galvanised steel strip, with zinc or a zinc-iron alloy in a galvanic cell comprising as the electrolyte liquid an aqueous solution of zinc chloride and iron chloride having a pH of 0.1–3.0, preferably 1.0–2.0 and using insoluble anodes.

In recent years a multitude of processes for zinc coating on one or both sides, in particular of steel strip has been described. In this context, on the one hand zinc electrolytes of the chloride type in combination with soluble anodes as well as zinc electrolytes of the sulphate type in combination with soluble or even insoluble anodes are employed. Examples of such processes are described, e.g. in EP-OS 151 235 or DE-OS 3 428 277. The advantages of zinc chloride electrolytes in combination with soluble anodes are described extensively in the literature and relate essentially to the improved conductivity as well as the somewhat improved electrical efficiency as compared with sulphate electrolytes. Iron contained in the electrolyte liquid does not enter into the coating or only slightly so. In conjunction with insoluble anodes extensive safety measures are often necessary due to the liberation of chlorine. On the other hand sulphate electrolytes are very sensitive to iron ions. As from a concentration of iron ions of about 4 g/l not only the appearance but also the protective properties of the galvanisation is impaired very considerably because of the substantially increased deposition of iron. In addition, the electrical efficiency is lowered from about 98% to 94% and less.

In WO91/04359 a process for the electrolytical coating of a metal object with zinc or zinc-iron alloy is described, involving the use of insoluble electrodes and an electrolyte of the chloride type, wherein the replenishment of the content of zinc and/or iron in the electrolyte takes place by way of regenerating tanks. The electrolyte is passed through these vessels charged with iron and/or zinc, metal entering into solution, whereafter the regenerated electrolyte liquid is again passed to the coating unit. However, this process, because of the additionally required regeneration tanks and the need for zinc and iron as raw materials, is complex and expensive.

The object of the present invention is a process of the type referred in the introduction in which, in a simple and economical manner, a continuous coating of the object is possible.

In order to attain this object the invention provides, when coating an object of steel, that the object prior to the galvanic coating is rinsed with the electrolyte liquid in the absence of current, iron entering into solution and the electrolyte liquid after the rinsing of the object, being passed to the galvanic cell.

When coating a hot dip galvanised object on the other hand, the invention provides that the object prior to the galvanic coating is rinsed with the electrolyte in the absence of current, zinc entering into solution and the electrolyte liquid after the rinsing of the object being passed to the galvanic cell.

Due to the rinsing of the object in the absence of current prior to coating with the electrolyte liquid provided for such coating, the adherence of the coating deposited is improved on the one hand and furthermore the object itself serves as the source for replenishing the metal content in the electrolyte liquid, so that additional regenerating tanks or dissolution columns, charged with the metal to be replenished, can be avoided.

In order to avoid the deposition of metallic iron onto the object to be coated almost completely and thereby to create a pure zinc coating, it is provided that for the deposition of metallic zinc a concentration of the zinc chloride solution of 50 to 1000 g/l, preferably 300 to 600 g/l zinc chloride and a concentration of iron-2-ions of 0.5 to 60 g/l, preferably 10 to 40 g/l is set up, a molar ratio of zinc to iron being maintained in the electrolyte of 3 or more.

Since it was surprisingly found that, within the above mentioned concentration range of bivalent iron in the electrolyte and a molar ratio of zinc to iron equal to or greater than 3, practically no iron is deposited on the object, it is provided in accordance with a further feature of the invention that, for the deposition of a zinc-iron alloy a molar ratio is set up in the electrolyte liquid of zinc to iron of less than 3.

The zinc coatings or the zinc-iron coatings, as the case may be, deposited in accordance with the aforesaid conditions, exhibit a uniform appearance in the entire range of current densities employed (10 to 200 A/dm$^2$) and in deep drawing experiments according to Erichsen excellent adherence as well as outstanding deep drawing properties were established.

Advantageously the temperature of the electrolyte liquid amounts to 20° to 80° C., preferably 50° to 60° C.

The cathodic efficiency of the process according to the invention ranges between 98 and 100%, and according to an additional integer the conductivity of the electrolyte solution can be improved by the addition of neutral salts for example sodium, potassium, ammonium or aluminium chloride at a concentration of 0 to 100 g/l, preferably 30 to 60 g/l. By comparison with conventional suphate electrodes the reduction of the bath voltage when using the conductive salts amounts to up to 40%.

The cathodic efficiency of the process according to the invention ranges between 98 and 100%, and according to an additional integer the conductivity of the electrolyte solution can be improved by the addition of neutral salts for example sodium, potassium, ammonium or aluminium chloride at a concentration of 0 to 100 g/l, preferably 30 to 60 g/l. By comparison with conventional sulphate electrodes the reduction of the bath voltage when using the conductive salts amounts to up to 40%.

A particularly advantageous modification of the process according to the invention relates to a single- or dual-sided electrolytic coating of an object of hot dip galvanised steel. According to the invention, prior to galvanic coating, the object is rinsed without current with the electrolyte liquid, with zinc of the object entering into solution and the electrolyte liquid after the rinsing of the object being passed into the galvanic cell. On the one hand this causes improvement of the adherence of the applied zinc coating and also the object itself serves as a source of zinc for the regeneration of the electrolyte liquid so that an additional dissolution station for zinc is rendered redundant.

The apparatus according to the invention for carrying out the process includes at least one galvanic cell, which is characterised in that the electrolyte liquid is an aqueous solution of zinc chloride and iron chloride and the insoluble anodes are composed of a carrier material of titanium, niobium or tantalum, onto which a coating of iridium oxide has been applied.

Advantageously it is further provided that the top of the anode resides 1 to 100 mm, preferably 20 to 50 mm, below the liquid level of the electrolyte liquid in the galvanic cell and that the current supply to the anode is made of anodically inert material.

In the following working examples of the invention are to be elucidated in more detail with reference to the accompanying drawings. There is shown in FIG. 1 the diagram of a galvanising section according to the invention, and FIG. 2 a corresponding diagram when using two dissolution stations.

Figure 3:
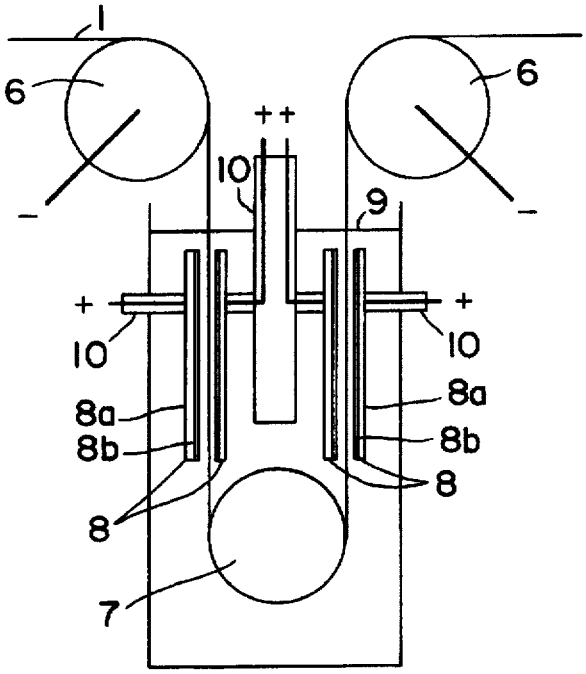
Figure 4:
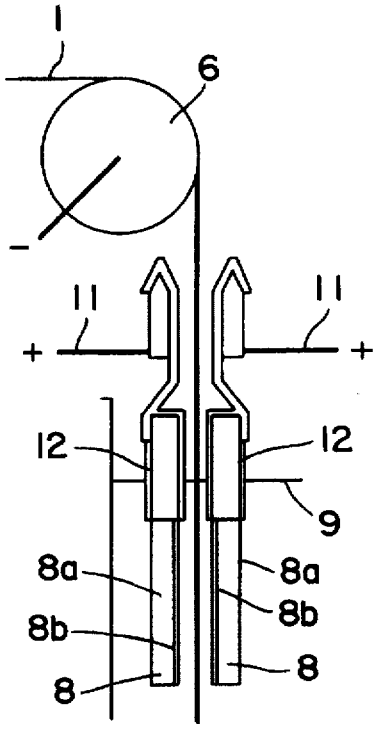

FIG. 3 represents diagrammatically a galvanic cell according to the invention, and FIG. 4 represents the upper portion of a cell according to a different embodiment.

Figure 2:
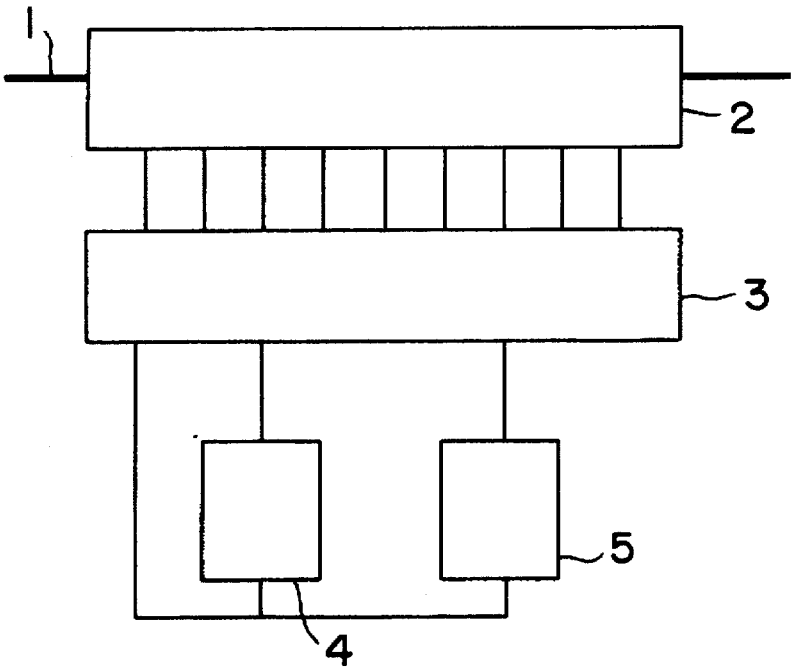

In accordance with FIGS. 1 and 2 a steel strip 1 is provided with a zinc coating in a galvanic section 2 using a zinc electrolyte based on chloride. The galvanic section 2 is replenished for that purpose from an operating tank 3, and the electrolyte returns again to that tank 3. According to the invention part of the electrolyte from the operating tank 3 is circulated by way of a dissolution column 4 filled with zinc. In that manner the zinc deposited on the steel strip from the electrolyte is replenished.

In an analogous manner, as illustrated in FIG. 2, a steel strip 1 is coated in a galvanic section 2 so as to deposit a zinc-iron alloy. Here as well an operating tank 3 for the electrolyte is provided of which one portion is circulated by way of a dissolution station 4 for zinc and another via a dissolution station 5 for iron in order to replenish the losses caused by the deposition.

FIG. 3 illustrates diagrammatically a galvanic cell for carrying out the invention in which the steel strip respectively the hot dip galvanised steel strip 1 enters the cell by way of a cathodically connected power supply roll 6, is passed vertically to a lower deflecting roll 7 and from there in turn to a further current supply roll 6 installed above the cell. It is important for the anodes 8 to be fitted below the liquid level 9 of the electrolyte, a minimum distance of 1 mm to be maintained. Preferably, however, distances of 20 to 50 mm are provided for. In order to avoid excessive power losses a maximum distance between the top of the anode and the liquid level 9 of 100 mm should not be exceeded. The power supply to the anodes 8 proceeds by way of insulated tubes or shafts 10.

As illustrated in FIGS. 3 and 4 the insoluble anodes 8 are composed of a carrier material **8*a* onto which a coating 8*b*** has been applied.

In FIG. 4 a modification for the current supply to the anodes 8 is illustrated. The power supply leads 11 in this case are outside the cell and above the electrolyte bath level 9, and in order to maintain the desired distance of the anode top from the bath level 9 the anodes 8 in their upper region are covered by an insulator 12. This serves to achieve that the anode proper, i.e. that portion of the overall anode construction which effectively participates in the deposition, is positioned to the desired extent below the liquid level 9 of the electrolyte.

In spite of what is shown in the drawings, neither the process according to the invention, nor the apparatus features are limited to horizontal cells and, in fact, horizontal designs are also possible.

EXAMPLE 1

In an electrolytic galvanising plant operating with cells of the Gravitel system a steel strip was coated on one side as well as on both sides with a zinc coating having a thickness of 10μ. As anodes for the coating insoluble anodes were used made of a titanium carrier material.

The current density was varied between 20 and 170 $A/dm^2$, the electrolyte temperature amounted to 55° C. and the pH of the electrolyte was set to 1.5.

A partial flow of the electrolyte was passed by way of a dissolution column packed with metallic zinc, and a pH of 1.5 was maintained therein.

In three tests runs a molar ratio of zinc to iron was set to values of 30, 15 and 10:1 respectively, and in all instances of these tests an iron content of less than 0.25% by weight was attained in the deposited metal coating. Moreover, during the entire duration of the tests no chlorine evolution in excess of the smell threshold of at the most 0.05 ppm was ever detected.

At the above mentioned molar ratios of zinc to iron the concentration of bivalent iron in the chloride electrode amounted to between 15 and 40 g/l, and by measuring the iron content of the deposited coating it was found that by comparison with a maximum of 4 g/l iron in sulphate electrolytes a lower percentage of iron was co-precipitated.

An analysis of the material produced exhibited a uniform appearance over the entire current density range and excellent deep drawing adherence properties.

EXAMPLE 2

In further experiments it was found that the use of chloride electrolytes was in no way restricted to the Gravitel system. In these tests a cell was employed which was filled completely with electrolyte and wherein the electrolyte was circulated by way of a pump and a dissolution column. The electrolyte flow enters in the lower region of the cell and exits in the upper region by way of an overflow weir. The cell was likewise equipped with insoluble anodes. In this type of galvanic cell as well it was possible to avoid chlorine formation by the method according to the invention provided the anodes were fitted below the liquid level, or the chlorine developed at the anodes was given sufficient time to react in the electrolyte with the bivalent iron present therein. The best results were attained with distances of the top of the anode from the liquid level of 1 to 100 mm. Larger distances are obviously also possible, however, in such cases the voltage required for the deposition of the zinc will be increased by the greater distance of the current supply roll from the anode.

EXAMPLE 3

In a further test the composition of the electrode was changed to a molar ratio of zinc to iron equal to 1:10 and a steel strip was coated using this electrolyte. In that case, using a current density range of 50 to 150 $A/dm^2$, a uniform coating of a zinc-iron alloy of 93% iron and 7% zinc was attained.

EXAMPLE 4

In a further test a steel strip which had previously been hot dip galvanised was used, and this was coated with a zinc-iron alloy. The adherence of the zinc layer was improved by rinsing with the electrolyte liquid in the absence of current and an additional dissolution station for zinc could be dispensed with. The available dissolution station was charged with metallic iron in order to replenish in the electrolyte bath the amount of iron deposited. The hot dip galvanised steel strip itself served as the source for replenishing the deposited zinc.

We claim:

1. In a process for the electrolytical coating of an object of steel on at least one side thereof, wherein in a galvanic cell containing an aqueous electrolyte solution of zinc chloride and ferrous chloride having a pH of between 0.1 and 3.0 and using insoluble anodes, metallic zinc or a zinc-iron alloy is deposited on the object which is connected as a cathode, the improvement comprising a partial flow of the electrolyte solution which is continuously conducted into a column filled with metallic zinc, a trivalent iron formed during electrolysis is reduced to a bivalent iron, and metallic zinc being dissolved simultaneously therewith by rinsing the surface of the steel object with the electrolyte solution, where an existing layer of zinc or zinc-iron alloy serves as metal source for the metallic zinc to be plated afterwards, and regenerated electrolyte solution being returned to the galvanic cell, wherein, for the deposition of metallic, zinc a concentration of the zinc chloride solution of 300–600 g/l zinc chloride and a concentration of iron-2-ions of 0.5–60 g/l is maintained, a molar ratio of zinc to iron being maintained in the electrolyte of three or more, producing a zinc iron layer with a content of iron of more than 93% and a content of zinc of less than 7% or a content of more than 99% zinc and of less than 1% iron.

2. A process as claimed in claim 1 wherein the object is a steel strip which is coated with zinc or a zinc-iron alloy.

3. A process as claimed in claim 1 wherein the pH is between 1.0 and 2.0.

4. A process as claimed in claim 1 wherein the concentration of iron-2-ions is 10 to 40 g/l.

5. A process as claimed in claim 1 wherein, for deposition of zinc-iron alloy, a molar ratio of zinc to iron of less than 3 is maintained in the electrolyte, and the deposited zinc and iron are replenished from dissolution columns charged with zinc and iron respectively.

6. A process as claimed in claim 1 wherein the electrolyte solution has a temperature of 20° C.–80° C.

7. A process as claimed in claim 6 wherein the temperature is 50° to 60° C.

8. A process as claimed in claim 1 wherein conductivity of the electrolyte solution is improved by the addition of neutral salts at a concentration of 0 to 100 g/l.

9. A process as claimed in claim 8 wherein the neutral salts are selected from the group consisting of sodium, potassium, ammonium and aluminum chloride.

10. A process as claimed in claim 8 wherein the concentration of the neutral salts is 30 to 60 g/l.

11. A process as claimed in claim 1 wherein the object of steel is coated on both sides thereof.

* * * * *